United States Patent [19]

Moranne

[11] 4,366,858

[45] Jan. 4, 1983

[54] SELF-DEAERATING HEAT EXCHANGER FOR ENGINE COOLING CIRCUITS

[75] Inventor: Jean-Pierre Moranne, Saint-Leu-la-Foret, France

[73] Assignee: Societe Anonyme des Usines Chausson, France

[21] Appl. No.: 205,126

[22] Filed: Nov. 10, 1980

[30] Foreign Application Priority Data

Nov. 16, 1979 [FR] France ..... 79 28313
Mar. 3, 1980 [FR] France ..... 80 04693

[51] Int. Cl.[3] ..... F28D 15/00
[52] U.S. Cl. ..... 165/104.32; 123/41.54
[58] Field of Search ..... 165/104.32, DIG. 24; 123/41.54

[56] References Cited

U.S. PATENT DOCUMENTS

| | | | |
|---|---|---|---|
| Re. 27,965 | 4/1974 | Avrea | 165/11 |
| 1,710,268 | 4/1929 | Muir | 123/41.27 |
| 3,051,450 | 8/1962 | White et al. | 257/125 |
| 3,533,465 | 10/1970 | Bennett | 165/104.32 X |
| 3,576,181 | 4/1971 | Neal et al. | 123/41.51 |
| 3,601,181 | 8/1971 | Avrea | 165/1 |
| 3,604,502 | 9/1971 | Morse et al. | 165/51 |
| 3,623,462 | 11/1971 | Anders et al. | 123/41.54 |
| 3,989,103 | 11/1976 | Cieszko et al. | 165/DIG. 24 |
| 4,098,328 | 7/1978 | Cheong | 165/107 |

FOREIGN PATENT DOCUMENTS

| | | | |
|---|---|---|---|
| 2741353 | 9/1977 | Fed. Rep. of Germany . | |
| 7522444 | 7/1975 | France . | |
| 1270238 | 4/1972 | United Kingdom | 123/41.54 |

*Primary Examiner*—Albert W. Davis, Jr.
*Attorney, Agent, or Firm*—Ward Brown; Robert W. Beach

[57] ABSTRACT

The outlet header tank forms two compartments separated by a partition wall provided with a hole in its lower portion and causing a pressure loss at least equal to the head of water in the header tank so that air possibly existing in the compartment is expelled via a pipe.

15 Claims, 7 Drawing Figures

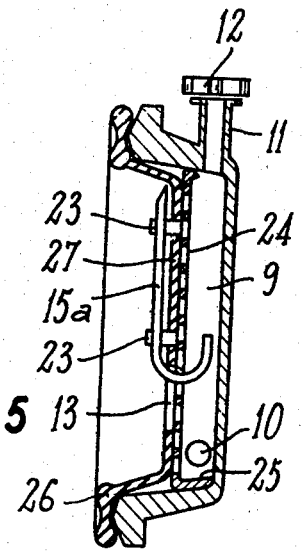
FIG. 5
FIG. 6
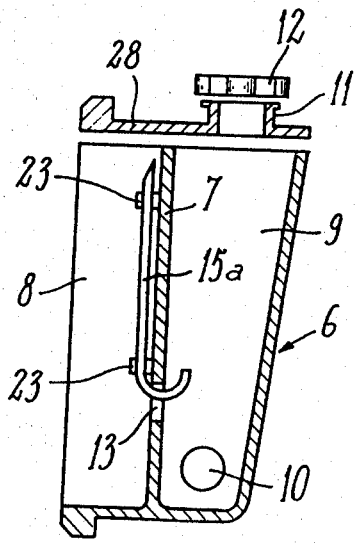

SELF-DEAERATING HEAT EXCHANGER FOR ENGINE COOLING CIRCUITS

BACKGROUND OF THE INVENTION

The present invention relates to heat exchangers and more particularly to heat exchangers used in the cooling circuits of thermal engines.

Heat exchangers or radiators having tubes placed horizontally and opening into tube plates covered by header tanks are used increasingly. It is frequent, taking in account the available space, particularly under the hood of a vehicle, that some of the horizontal tubes of the heat exchanger form the higher portion of the cooling circuit, and consequently, if the cooling circuit contains air, the air is found in the tubes of the upper rows.

In addition to the fact that this air reduces the thermal exchange capacity of the heat exchanger, it results in still more serious disadvantages. Actually, when hot liquid is conveyed to the heat exchanger, those of the tubes through which the liquid flows are abruptly expanded, in particular at their junction with the tube plates, whereas those containing air are not subjected at the same time to heat expansion, and the resulting differential heat expansion may frequently cause rupture of the connection between the tubes and the tube plates.

DISCLOSURE OF PRIOR ART

U.S. Pat. No. 3,576,181 shows a system in which a water aspirator 7 or other suction means extracts the air from the outlet header tank of the heat exchanger for conveying the air towards a makeup tank containing a reserve of cooling liquid. Inside the makeup tank are provided a partition wall and a siphon the function of which is to prevent air from being sucked back through a duct connecting the bottom of the makeup tank with the bottom of the header tank of the heat exchanger and, consequently, with a liquid feed tube leading to the device to be cooled.

German Pat. No. 2,741,353 describes a heat exchanger with an outlet header tank comprising three chambers in which are provided communication openings connecting the top of the three chambers and a communication duct connecting the bottom of the intermediate chamber with the most extreme chamber which comprises a filler spout. In use, air which may exist in the higher tubes is aspirated due to the circulation which is established from the lowest portion of the most outer chamber. However, this outer chamber as well as the intermediate chamber contain air at their upper portion and, when the circulation of the liquid stops in the heat exchanger, air may flow again into the tubes which are at the most upper portion of the heat exchanger.

U.S. Pat. No. 3,051,450 comprises a discharge header tank divided into two compartments by a vertical partition wall having communication slots. The liquid coming from the tubes of the heat exchanger is aspirated via a conduit placed in the first compartment which is nearest the outlet of the tubes. The dynamic circulation of the liquid is such that a portion of the liquid passes through the upper slot in the partition, this slot being provided with a deflector, and, consequently, the air bubbles carried along by the flow of liquid have a tendency to escape into the outer compartment. When the circulation will stop, air may reenter the tubes which are in the highest position since the two compartments form communication vessels.

U.S. Pat. No. 3,604,502 discloses a header tank in which are formed two chambers separated by a partition wall but which can communicate by a valve means placed at the top portion of the partition wall. The two compartments of the header tank are connected together by a bypass duct for creating a suction in that of the compartments which is in direct communication with the tubes.

U.S. Pat. No. 4,098,328 discloses a heat exchanger the outlet header tank of which is divided into two compartments by a perforated partition wall which forms a tranquilisation or calming grid so that the outermost compartment, in which comes the filling duct as well as the cooling liquid return duct, will contain liquid which is calmed down and, consequently, there is a lesser risk that air bubbles are sent back into the circuit.

French Pat. No. 75-22 444 published under No. 2,278,914 discloses a device intended for being mounted on existing heat exchangers comprising an aspirating member extending into the outlet header tank of the heat exchanger, said device comprising a valve mechanism for preventing return of air after the aspiration thereof which is produced in an adjoined makeup tank. The above French patent incorporates by way of reference U.S. Pat. Nos. Re. 27,965 and 3,601,181 concerning similar matters.

SUMMARY OF THE INVENTION

The present invention provides a novel heat exchanger exhibiting the advantage of not necessitating installation of an independent expansion tank or makeup tank in the cooling liquid circulation circuit.

Moreover, the heat exchanger of the invention provides a permanent degassing of the circuit without any operation to be carried out after a first starting step.

According to the invention, the self-deaerating heat exchanger for engine cooling circuits, of the type in which the tubes are placed horizontally and connected by tube plates covered by an inlet and an outlet header tanks is characterized in that the outlet header tank comprises a partition wall vertically dividing the header tank into a first and a second compartments, the first compartment communicating with the tubes and the second compartment communicating with a top placed filling spout and with a bottom placed liquid return tubing, the partition wall comprising an opening having a passage cross-section causing a pressure loss at least equal to head of water in the tank for the liquid flowing from one compartment to the other, this opening being provided below level of the liquid in the second compartment, and a pipe open at its two ends extending from top of the first compartment to a level of the second compartment situated below level of the liquid in said second compartment.

Various further features of the invention will become apparent from the following detailed description. dr

BRIEF DESCRIPTION OF THE DRAWINGS

Embodiments of the invention are shown, as non limiting examples, in the accompanying drawings wherein:

FIG. 5 is an elevation cross sectional view illustrating an alternative embodiment of the header tank forming a makeup tank;

FIG. 6 is a diagrammatic elevation cross-sectional view of a further alternative embodiment;

PREFERRED EMBODIMENTS OF THE INVENTION

Figure 1:
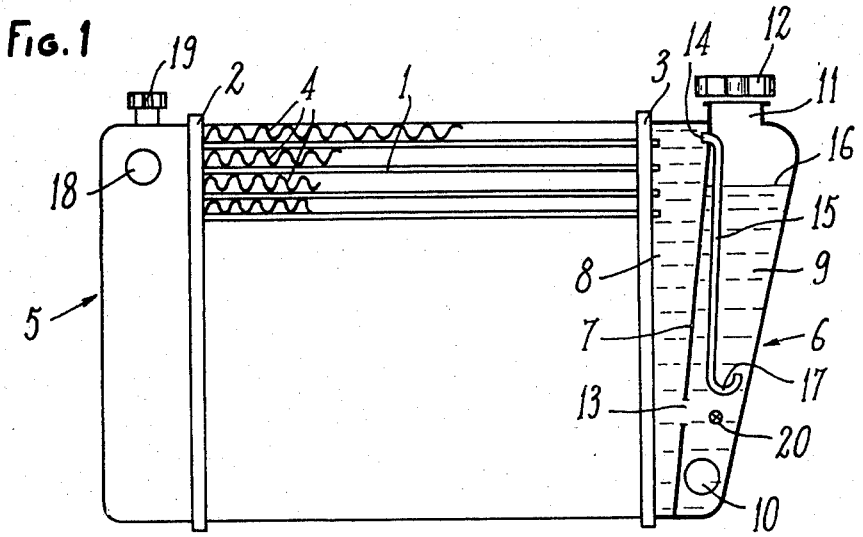
FIG. 1 is an elevation view, partly cut away, of a self-deaerating heat exchanger with a built-in makeup tank carying out the invention into effect.

FIG. 1 shows a cooling heat exchanger for a motor vehicle, comprising tubes 1 placed horizontally and opening into two tube plates 2 and 3. In a known manner, the tubes are connected together by secondary heat exchange elements in the form of corrugated fins 4.

The tube plates 2 and 3 are covered and tightly connected together by header tanks 5, 6. The header tank 6 is made so as to provide at the same time a makeup tank and a self-deaerating device. The drawing shows, in fact, that the header tank 6 insidely comprises a partition wall 7 which divides it, in vertical direction, into two compartments 8 and 9.

The compartment 8 communicates with the various tubes 1 and is intended for being always filled with a coolant liquid. The compartment 9 forms a makeup tank and a return compartment for the cooled liquid which is directed towards the cooling jackets of an engine via a tubing 10 provided at the bottom of the compartment 9. Moreover, the compartment 9 communicates at its upper portion with a filling spout 11 normally closed by a plug 12 which is advantageously of the type incorporating over and underpressure valves.

The partition wall 7 comprises a port or passage opening 13, preferably formed at its lower portion. The passage cross-section of the port 13 is chosen such as to create a pressure loss, the measure of which is at least equal to the pressure corresponding to the water head between the port 13 and the highest portion of the compartment 8.

The partition wall 7 comprises, at its upper portion and at a level at least equal to that of the tube 1 which is the highest tube, a hole 14 in which is placed the inlet of a pipe 15 opening inside the compartment 9 (preferably at the lower portion of the compartment) so that the mouth of the pipe 15 is always below the level 16 of the liquid which is in the compartment 9.

It is advantageous, as shown in the drawing, that the pipe 15 is bent at its lower portion at 17, so that the mouth of the pipe is upwardly directed.

The liquid to be cooled down, and coming from the engine jackets, is conveyed for example by a flexible hose connection to a tubing 18 provided in the inlet header tank 5 and distributing the liquid to be cooled down in the tubes 1.

The header tank 5 also comprises a plug 19 for connecting it with the open air and which is placed at its upper portion.

For filling the heat exchanger and the circuit of which it is part, the plug 19 communicating with the open air is opened as well as the filling spout 12. Liquid is poured via the spout 11 and fills progressively the heat exchanger and the circuit by passing through the compartment 9, port 13 and compartment 8. The plug 19 for communication with the open air is then closed in position as well as the plug 12. The engine is then put to run until it reaches its normal operation temperature, for example until starting of the cooling fan which is normally provided with the cooling radiator and which can be controlled by a thermostatic cartridge 20 placed in the compartment 9.

A large amount of the air contained in the cooling circuit accumulates in compartment 9 in which the liquid level goes down. This is due to the pressure loss created by the opening 13 forcing the liquid to move up to the highest tube of the heat exchanger by driving the air back into the compartment 8 at the top of which said air has a tendency to accumulate but from which it is driven back through the hole 14 and the pipe 15. Once the engine is stopped, filling of liquid is completed via the plug 12 without opening again the plug 19, and this by leaving only a small quantity of air above the liquid level 16. For example, the level 16 is brought to about 5 cm of the spout 11 on which is fixed the plug 12. The vehicle is then ready to move.

Then, in normal operation, the liquid flows necessarily through all the tubes 1, including the tubes which are at the highest level, since the circulation is always established, on the one hand, through the opening 13, and on the other hand through the hole 14 and the pipe 15. There is thus ensured that there is never any air in the tubes 1 which are at the highest level.

After a prolonged stop of the engine, the water cools down naturally, the tubes 1 and the compartment 8 remaining nevertheless full of water since the pipe 15 aspirates water into the compartment 9 and the heat exchanger is thus always in the best possible operating conditions.

The header tanks 5 and 6 may be made in various ways, and particularly the header tank 6 forming the makeup tank may be made for example as shown in FIGS. 2–5.

Figure 2:
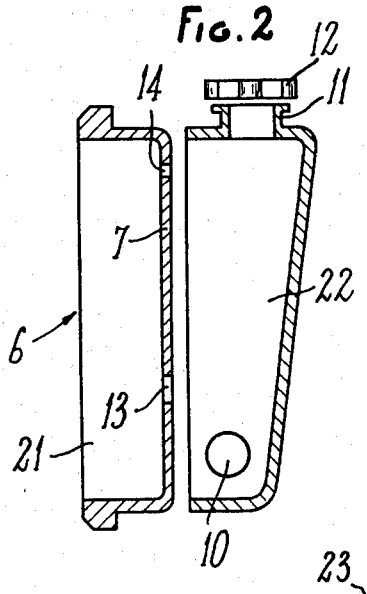
FIG. 2 is an exploded cross sectional view showing an embodiment of a header tank forming a makeup tank.

In FIG. 2, the water box is made of two complementary parts 21 and 22, the part 21 forming the partition wall 7 in which are made the opening 13 and the hole 14. The two parts 21 and 22 may be made of a molded synthetic material or of a metal, and they are joinded together by any suitable means known in the art. The connection between the two parts is carried out after having positioned the pipe 15, which can be made of metal or of a synthetic material, and which is then glued or connected by any other means such as by friction, ultra-sounds, etc.

Figure 3:
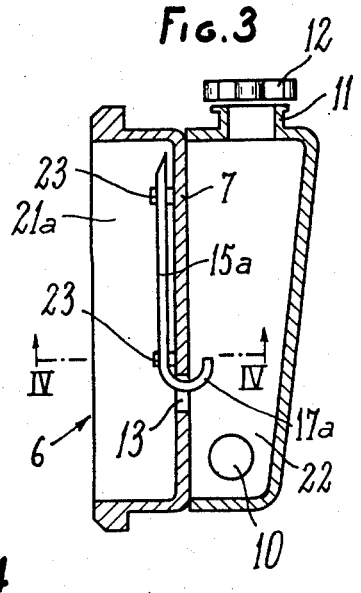
FIG. 3 is an exploded elevation cross-sectional view illustrating an alternative embodiment of the header tank forming a makeup tank.
Figure 4:
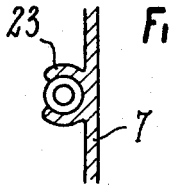
FIG. 4 is a cross-sectional view substantially along line IV—IV of FIG. 3.

In FIG. 3, the part 22 is made as shown in FIG. 2, but the part 21*a* comprises, from the partition wall 7, clamps 23 which are well seen in FIG. 4. Moreover, the hole 14 does not exist any more. In this embodiment, there is placed a pipe 15*a* the bent end 17*a* of which extends through the opening 13 when the pipe is secured by the clamps 23. The upper end of the pipe 15*a* is bevelled and opens in the top of the part 21*a* which is intended for delimiting compartment 8.

The embodiment of FIG. 3 permits fixing pipe 15*a* once the two parts 21*a* and 22 forming the header tank 6 are connected together.

In the embodiment shown in FIGS. 2 and 3, it is advantageous, as is already disclosed above, to make the header tank 6 of a molded material, but it can obviously made also of metal, typically of a stamped metal, the two parts being connected either by brazing, or by crimping as taught by the art.

In FIG. 5, the header tank is made of moldered material in a manner quite similar to a conventional header tank and a grid 24 is placed inside the header tank. The grid 24 comprises spacers 25 for maintaining it at a distance from the bottom of the header tank and thus delimiting the compartment 9.

In this case, a gasket 26 is provided for ensuring the tightness between the header tank and the tube plate 3 in such a manner that the gasket will form at the same time a diaphragm 27 in which is made the opening 13. The diaphragm 27 also forms the lugs 23 used for positioning the pipe 15*a*.

In FIG. 6, the header tank 6 is made of a molded material, preferably a synthetic resin, so as to form the two compartments 8 and 9 as well as the partition wall 7, but the header tank is opened at its end forming the filling spout. Thus, the lugs 23 provided for the pipe 15*a* may be easily molded together with the header tank. A cover 28 comprising the spout 11 is made by molding in the same way, and the cover is then connected to the header tank by ultrasounds or any other known process.

Figure 7:
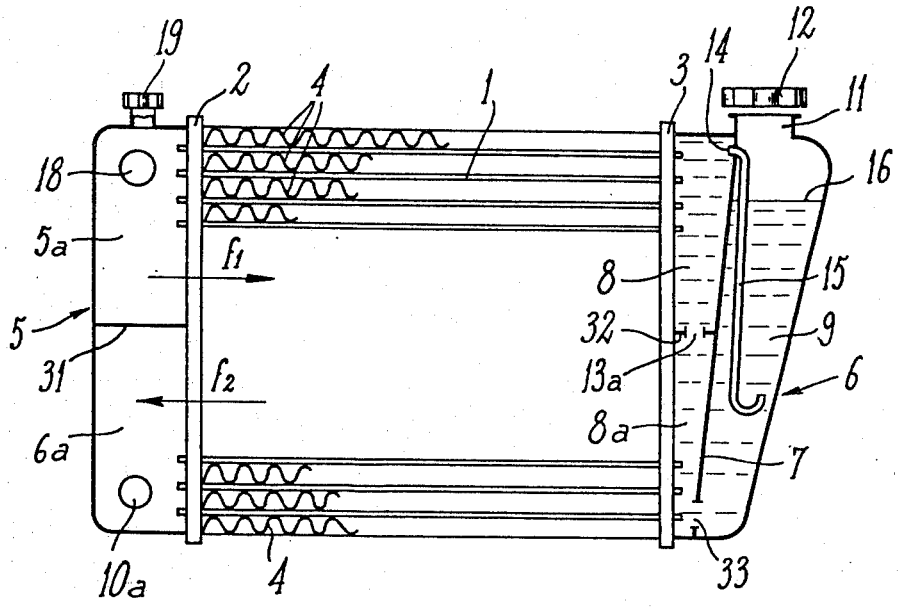
FIG. 7 is a diagrammatic elevation cross-sectional view of a self-deaerating heat exchanger with a looped circulation and built-in makeup tank carrying out the invention into effect.

According to FIG. 7, in order that the heat exchanger may operate according to a so-called looped circulation, the tank 5 is provided in known manner with a transverse partition wall 31 forming two superimposed compartments 5*a*, 6*a*. The liquid to be cooled down is brought into the compartment 5*a* by a tubing 18, and due to the presence of the transverse partition wall 31, the liquid is caused to flow first in direction of arrow $f_1$ towards the compartment 8 and, then, from the compartment 8 in direction of arrow $f_2$, in order to flow into the compartment 6*a* which is provided with a drain tubing 10*a*.

The compartment 8 is itself divided into two compartments 8, 8*a* by an auxiliary transverse partition wall 32 delimiting a calibrated port 13*a* introducing a pressure loss in the liquid circulating from the compartment 8 to the compartment 8*a*. The pressure loss may be for example equal to the head of water in the header tank and is at least equal to a measure for which there exists always in the compartment 8 a higher pressure than that prevailing at the lower mouth of the pipe 15. A hole 33 is also provided in the partition wall 7 in vicinity of its bottom and in any case below the liquid level 16 for permitting to fill the circuit and providing a possibility for the level 16 to be variable in the compartment 9 forming the makeup tank.

The invention is not restricted to the embodiments shown and described in detail, since various modifications may be carried out without departing from its scope as shown in the appendent claims. Particularly, the partition wall 32 may be formed by a simple rib extending from the partition wall 7 and to a certain distance from the tube plate 3.

I claim:

1. A self-deaerating heat exchanger for engine cooling circuits, of the type in which coolant tubes are placed horizontally and connected by tube plates covered by inlet and outlet header tanks containing coolant liquid, wherein a vertical partition wall divides the outlet tank into first and second compartments, the first compartment communicating with the coolant tubes and the second compartment communicating both with a filling spout opening in the upper portion thereof and with a liquid return means opening in the bottom portion thereof, the partition wall having a lower opening having a passage cross-section causing a pressure loss at least equal to the head of liquid in the outlet tank for the liquid flowing from one compartment to the other, said lower opening being provided below the level of liquid in the second compartment, and a pipe open at the two ends thereof extending from the top portion of the first compartment to a level of the second compartment situated below the level of liquid in said second compartment.

2. A heat exchanger according to claim 1, wherein said pipe has a bent bottom portion including an end portion directed upwardly inside the second compartment.

3. A heat exchanger according to claim 1, wherein the pipe has an upper end portion mounted in an upper hole in the partition wall at a level at least equal to the level of the highest coolant tube or tubes of the heat exchanger.

4. A heat exchanger according to claim 1, wherein the pipe extends in part in the first compartment, said pipe having one end opening into the top portion of said first compartment and having a bent portion which extends through the partition wall lower opening causing a pressure loss between the two compartments.

5. A heat exchanger according to claim 1, wherein the inlet header tank comprises at least one tubing for feeding coolant liquid, and a plug at the upper portion thereof for connecting it with the free air.

6. A heat exchanger according to claim 1, wherein the header tank is made of first and second complementary parts, the first part being shaped so as to be tightly assembled to a tube plate and having a bottom portion in which is formed the partition wall lower opening, and the second part being in the shape of an open tank which forms a tubing for draining away coolant liquid as well as a filling spout adapted for being closed by a plug.

7. A heat exchanger according to claim 6, wherein said plug includes an over- and under-pressure valve.

8. A heat exchanger according to claim 1, wherein the outlet header tank comprising the partition wall is made of a molded material.

9. A heat exchanger according to claim 1, wherein the outlet header tank is made of a molded material for delimiting, in the vicinity of the top of the outlet header tank intended for extending in an approximately vertical direction, a filling spout and, in the vicinity of the lower portion of the outlet header tank, a draining tubing, said header tank having a free edge forming a bearing heel for deforming a sealing gasket interposed between the outlet header tank and the tube plate, said sealing gasket forming a diaphragm in which is formed the partition wall lower opening causing a pressure loss, said diaphragm bearing against a grid kept at a distance from the bottom of the outlet header tank by spacers.

10. A heat exchanger according to claim 1, wherein clamps project from the partition wall for securing the pipe opening in the upper portion of the outlet header tank and extending through the partition wall lower opening causing a pressure loss.

11. A heat exchanger according to claim 9, wherein clamps project from the diaphragm for securing the pipe opening in the upper portion of the outlet header tank and extending through the partition wall lower opening causing a pressure loss.

12. A heat exchanger according to claim 1, wherein the second compartment is provided with a capacity sufficient for forming a makeup tank.

13. A heat exchanger according to claim 1, wherein the outlet header tank is made of a molded synthetic material for delimiting the two compartments and the partition wall separating them, said outlet header tank being open at the upper portion thereof and receiving a cover also made of a molded synthetic material and fixed thereto.

14. A heat exchanger according to claim 1, wherein the inlet header tank is divided in a known manner by a transverse partition wall, feeding tubings and drain tubings being provided, respectively, in two compartments which are formed by said transverse partition wall, and wherein a calibrated port is formed in an auxiliary partition wall dividing the first compartment communicating with the coolant tubes into two compartments so that the pressure loss created by the calibrated port causes an overpressure at the top portion of the first compartment.

15. A heat exchanger according to claim 12, wherein the transverse partition wall dividing the first compartment is formed by a rib protruding towards the tube plate.

* * * * *